US006302523B1

(12) United States Patent
Smith et al.

(10) Patent No.: US 6,302,523 B1
(45) Date of Patent: Oct. 16, 2001

(54) INK JET PRINTHEADS

(75) Inventors: Thomas W. Smith, Penfield; John R. Andrews, Fairport; Reinhold E. Drews, Pittsford, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/356,661

(22) Filed: Jul. 19, 1999

(51) Int. Cl.[7] ..... B41J 2/135
(52) U.S. Cl. ..... 347/45; 430/320
(58) Field of Search ..... 347/45, 44, 47, 347/63, 20; 89/290.1; 430/320

(56) References Cited

U.S. PATENT DOCUMENTS

| | | | | |
|---|---|---|---|---|
| 4,587,136 | * | 5/1986 | White et al. | 427/54.1 |
| 5,121,134 | | 6/1992 | Albinson et al. | 347/45 |
| 5,136,310 | * | 8/1992 | Drews | 347/45 |
| 5,212,496 | | 5/1993 | Badesha et al. | 347/45 |

FOREIGN PATENT DOCUMENTS

| | | | | |
|---|---|---|---|---|
| 8824436 | | 11/1988 | (GB) . | |
| 359194864 | * | 11/1984 | (JP) | 347/45 |

OTHER PUBLICATIONS

"Plasma Deposition on Thin Films from a Fluorine–Containing Cyclosiloxane," P. Favia et al., *Journal of Polymer Science: Part A: Polymer Chemistry*, vol. 32, 121–130 (1994).

"Laser–Induced Generation of Thin Silicone Layers with High Chemical and Spectral Purity," W. Roth et al., *Journal of Polymer Science: Part A: Polymer Chemistry*, vol. 32, 1893–1898 (1994).

"Silicones in the UV/EB Coatings Industry: Influence of Chemical Structure on Performance," E. Orr, Journal of Radiation Curing, vol. 22, No. 1, 13–19 (1995).

"Excimer Laser Photolysis of Metalorganic Complexes of Platinum and Palladium in the Gas Phase," H. Willwohl et al., *Appl. Surf. Sci.*, vol. 54, 89–94 (1992).

"Deposition of High Quality $SiO_2$ Layers from TEOS by Excimer Laser," A. Klumpp et al., *Appl. Surf. Sci.*, vol. 36, 141–149 (1989).

* cited by examiner

*Primary Examiner*—John E. Barlow, Jr.
*Assistant Examiner*—Juanita Stephens
(74) *Attorney, Agent, or Firm*—Judith L. Byorick

(57) ABSTRACT

Disclosed is an ink jet printhead comprising a plurality of channels, wherein the channels are capable of being filled with ink from an ink supply and wherein the channels terminate in nozzles on one surface of the printhead, said surface having covalently bonded thereto a coating of an organosiloxane polymer, said organosiloxane polymer coating being substantially uniform with no additional layers thereover.

25 Claims, 9 Drawing Sheets

INK JET PRINTHEADS

BACKGROUND OF THE INVENTION

The present invention is directed to printheads useful for ink jet printing processes. More specifically, the present invention is directed to printheads having improved ink repellency on the front faces or nozzle plates thereof. One embodiment of the present invention is directed to an ink jet printhead comprising a plurality of channels, wherein the channels are capable of being filled with ink from an ink supply and wherein the channels terminate in nozzles on one surface of the printhead, said surface having covalently bonded thereto a coating of an organosiloxane polymer, said organosiloxane polymer coating being substantially uniform with no additional layers thereover. Another embodiment of the present invention is directed to a process for preparing a printhead suitable for ink jet printing which comprises (a) providing an ink jet printhead comprising a plurality of channels, wherein the channels are capable of being filled with ink from an ink supply and wherein the channels terminate in nozzles on one surface of the printhead; (b) applying to said surface a coating of a composition comprising an organosiloxane polymer precursor material; and (c) exposing said organosiloxane precursor material to ultraviolet radiation, thereby causing polymerization, chain extension, and/or crosslinking of the precursor material and covalent bonding of the polymerized, chain extended, and/or crosslinked organosiloxane polymer thereby formed to the surface, said polymerized, chain extended, and/or crosslinked organosiloxane polymer coating being substantially uniform with no additional layers thereover. Yet another embodiment of the present invention is directed to a printing process which comprises (1) providing an ink jet printer containing a printhead comprising a plurality of channels, wherein the channels are capable of being filled with ink from an ink supply and wherein the channels terminate in nozzles on one surface of the printhead, said surface having covalently bonded thereto a coating of an organosiloxane polymer, said organosiloxane polymer coating being substantially uniform with no additional layers thereover; (2) incorporating into the printer an ink composition; and (3) causing droplets of the ink to be ejected in an imagewise pattern onto a recording sheet to form an image.

Ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a-fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Since drop-on-demand systems require no ink recovery, charging, or deflection, the system is much simpler than the continuous stream type. There are three types of drop-on-demand ink jet systems. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies.

Another type of drop-on-demand system is known as acoustic ink printing. As is known, an acoustic beam exerts a radiation pressure against objects upon which it impinges. Thus, when an acoustic beam impinges on a free surface (i.e., liquid/air interface) of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power. These principles have been applied to prior ink jet and acoustic printing proposals. For example, K. A. Krause, "Focusing Ink Jet Head," *IBM Technical Disclosure Bulletin,* Vol 16, No. 4, Sept. 1973, pp. 1168–1170, the disclosure of which is totally incorporated herein by reference, describes an ink jet in which an acoustic beam emanating from a concave surface and confined by a conical aperture was used to propel ink droplets out through a small ejection orifice. Acoustic ink printers typically comprise one or more acoustic radiators for illuminating the free surface of a pool of liquid ink with respective acoustic beams. Each of these beams usually is brought to focus at or near the surface of the reservoir (i.e., the liquid/air interface). Furthermore, printing conventionally is performed by independently modulating the excitation of the acoustic radiators in accordance with the input data samples for the image that is to be printed. This modulation enables the radiation pressure which each of the beams exerts against the free ink surface to make brief, controlled excursions to a sufficiently high pressure level for overcoming the restraining force of surface tension. That, in turn, causes individual droplets of ink to be ejected from the free ink surface on demand at an adequate velocity to cause them to deposit in an image configuration on a nearby recording medium. The acoustic beam may be intensity modulated or focused/defocused to control the ejection timing, or an external source may be used to extract droplets from the acoustically excited liquid on the surface of the pool on demand. Regardless of the timing mechanism employed, the size of the ejected droplets is determined by the waist diameter of the focused acoustic beam. Acoustic ink printing is attractive because it does not require the nozzles or the small ejection orifices which have caused many of the reliability and pixel placement accuracy problems that conventional drop on demand and continuous stream ink jet printers have suffered. The size of the ejection orifice is a critical design parameter of an ink jet because it determines the size of the droplets of ink that the jet ejects. As a result, the size of the ejection orifice cannot be increased, without sacrificing resolution. Acoustic printing has increased intrinsic reliability because there are no nozzles to clog. As will be appreciated, the elimination of the clogged nozzle failure mode is especially relevant to the reliability of large arrays of ink ejectors, such as page width arrays comprising several thousand separate ejectors. Furthermore, small ejection orifices are avoided, so acoustic printing can be performed with a greater variety of inks than conventional ink jet printing, including inks having higher viscosities and inks containing pigments and other particulate components. It has been found that acoustic ink printers embodying printheads comprising acoustically illuminated spherical focusing lenses can print precisely positioned pixels (i.e., picture elements) at resolutions which are sufficient for high quality printing of relatively complex images. It has also has been discovered that the size of the individual pixels printed by such a printer can be varied over a significant range during operation, thereby accommodating, for example, the printing of variably shaded images. Furthermore, the known droplet ejector technology can be adapted to a variety of printhead configurations, including (1) single ejector embodiments for raster scan printing, (2) matrix configured ejector arrays for matrix printing, and (3) several different types of pagewidth ejector arrays, ranging from single row, sparse arrays for hybrid forms of parallel/serial printing to multiple row staggered arrays with individual ejectors for each of the pixel positions or addresses within a pagewidth image field (i.e., single ejector/pixel/line) for ordinary line printing. Inks suitable for acoustic ink jet printing typically are liquid at ambient temperatures (i.e., about 25° C.), but in other embodiments the ink is in a solid state at ambient temperatures and provision is made for liquefying the ink by heating or any other suitable method prior to introduction of the ink into the printhead. Images of two or more colors can be generated by several methods, including by processes wherein a single printhead launches acoustic waves into pools of different colored inks. Further information regarding acoustic ink jet printing apparatus and processes is disclosed in, for example, U.S. Pat. Nos. 4,308,547, 4,697,195, 5,028,937, 5,041,849, 4,751,529, 4,751,530, 4,751,534, 4,801,953, and 4,797,693, the disclosures of each of which are totally incorporated herein by reference. The use of focused acoustic beams to eject droplets of controlled diameter and velocity from a free-liquid surface is also described in *J. Appl. Phys.,* vol. 65, no. 9 (1 May 1989) and references therein, the disclosure of which is totally incorporated herein by reference.

Still another type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands until all the heat stored in the ink in excess of the normal boiling point diffuses away or is used to convert liquid to vapor, which removes heat due to heat of vaporization. The expansion of the bubble forces a droplet of ink out of the nozzle, and once the excess heat is removed, the bubble collapses on the resistor. At this point, the resistor is no longer being heated because the current pulse has passed and, concurrently with the bubble collapse, the droplet is propelled at a high rate of speed in a direction towards a recording medium. The resistive layer encounters a severe cavitational force by the collapse of the bubble, which tends to erode it. Subsequently, the ink channel refills by capillary action. This entire bubble formation and collapse sequence occurs in about 10 microseconds. The channel can be refired after 100 to 500 microseconds minimum dwell time to enable the channel to be refilled and to enable the dynamic refilling factors to become somewhat dampened. Thermal ink jet processes are well known and are described in, for example, U.S. Pat. Nos. 4,601,777, 4,251,824, 4,410,899, 4,412,224, and 4,532,530, the disclosures of each of which are totally incorporated herein by reference.

"Plasma Deposition of Thin Films from a Fluorine-Containing Cyclosiloxane," P. Favia et al., *Journal of Polymer Science: Part A: Polymer Chemistry,* Vol. 32, 121–130 (1994), the disclosure of which is totally incorporated herein by reference, discloses the deposition of thin films from radio-frequency glow discharges fed with vapors of a silicon- and fluorine-containing organic compound, namely 2,4,6-tris((3,3,3-trifluoropropyl)(methyl))cyclotrisiloxane, of the formula

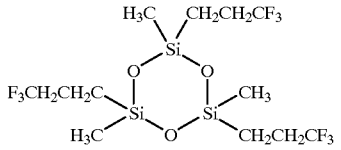

in mixture with argon. A triode reactor was used to deposit films by independently changing substrate temperature and bias-induced ion-bombardment. Laser interferometry, electron spectroscopy for chemical analysis, and Fourier-transform infrared spectroscopy were used to monitor film growth rate and composition. The results showed an activating effect of the ion-bombardment. Low substrate temperature and bias conditions resulted in films with a "monomer-like" stoichiometry, while drastic conditions gave origin to materials with a completely different composition and a markedly increased hardness.

"Laser-induced Generation of Thin Silicone Layers with High Chemical and Spectral Purity," W. Roth et al., *Journal of Polymer Science: Part A: Polymer Chemistry,* Vol. 32, 1893–1898 (1994), the disclosure of which is totally incorporated herein by reference, discloses the use of excimer lasers (ArF, $\lambda$=193 nm, and KrF, $\lambda$=248 nm) to generate polymers free of additives such as catalysts, initiators, or sensitizers. The layers obtained were of potential interest for medical applications and future molecular electronics. Dimethylpolysiloxanes and dimethylsiloxane copolymers containing phenyl-, n-hexyl-, or 3,3,3-trifluoropropyl groups or silicon-bound hydrogen atoms were crosslinked in the liquid phase, whereby layer thicknesses in the range from 1 to 300 microns were obtained. Disiloxanes and alkoxysilanes were deposited from the gas phase (laser chemical vapor deposition), resulting in layer thicknesses below 1 micron. In almost all cases, organic layers with a smooth surface, transparency, and good adhesion were obtained on silicon as well as quartz substrates.

"Silicones in the UV/EB Coatings Industry: Influence of Chemical Structure on Performance," E. Orr, Journal of Radiation Curing, Vol. 22, No. 1, 13–19 (1995), the disclosure of which is totally incorporated herein by reference, discloses an analysis of silicones with special emphasis on polyether-modified and polyester-modified polysiloxanes. The chemical determinants of silicone performance are outlined for UV/EB coatings, inks, adhesives, and related applications. Structure-performance correlations, system compatibility, surface tension effects, thermostability, wetting/leveling, and slip/mar resistance are also discussed.

"Excimer Laser Photolysis of Metalorganic Complexes of Platinum and Palladium in the Gas Phase," H. Willwohl et al., *Appl. Surf. Sci.,* Vol. 54, 89–94 (1992), the disclosure of which is totally incorporated herein by reference, discloses the KrF-excimer-laser-photolysis (248 nm) of the bishexafluoroacetylacetonates of platinum and palladium in the gas phase. Platinum bishexafluoroacetylacetonates are identified as precursors in laser chemical vapor deposition.

"Deposition of High Quality $SiO_2$ Layers from TEOS by Excimer Laser," A. Klumpp et al., *Appl. Surf. Sci, Vol.* 36, 141–149 (1989), the disclosure of which is totally incorporated herein by reference, discloses the deposition of $SiO_2$ layers on silicon wafers from a mixture of tetraethylorthosilicate and oxygen by ArF-excimer laser radiation. The deposition conditions were studied as a function of substrate temperature, partial pressure, and laser fluency. Deposition rates as high as 2,000 Å/min at pulse energies of 100 mJ/$cm_2$ were obtained. The physical properties of the $SiO_2$ layers were investigated by FT-IR spectroscopy, Rutherford backscattering, and ellipsometry. The electrical properties of breakdown voltage, interface state density, and mobile-ion density are also given. The $SiO_2$ layers show nearly the same quality as thermally grown $SiO_2$ layers.

U.S. Pat. No. 5,212,496 (Badesha et al.), the disclosure of which is totally incorporated herein by reference, discloses an ink jet recording head comprising a plurality of channels, wherein the channels are capable of being filled with ink from an ink supply and wherein the channels terminate in nozzles on one surface of the printhead, the surface being coated with a polyimide-siloxane block copolymer.

U.S. Pat. No. 5,121,134 (Albinson et al.), the disclosure of which is totally incorporated herein by reference, discloses a method of providing the surface area of a substrate with a first zone which is solvent wettable and a second zone which is solvent nonwettable, and which is particularly suitable for application to the printheads and nozzle plates of drop-on-demand ink jet printers or like products where the spacing between zones of the same kind can be as little as just tens of microns, and wherein the solvent nonwettable zone displays excellent abrasion resistance and resistance to solvents, is virtually nonwettable by a wide range of solvents, and bonds well even to plastic substrates. The method comprises (1) providing a surface having good solvent wettability at least over that part of the area of the substrate which is to form the first zone; (2) providing the area with a first layer which comprises siloxic material which bonds to the substrate and which is in contact with the substrate over at least that part of the area which is to form the second zone; (3) providing the area with an overlayer comprising organic fluorocompound which bonds to the first layer and provides a surface of poor solvent wettability, said overlayer being in contact with the first layer over at least that part of the area which is to form the second zone; and (4) by etching or washing, removing overlying material from the surface having good solvent wettability over that part of the area which is to form the first zone whereby to expose said surface.

British Patent Document GB 8824436 A0, the disclosure of which is totally incorporated herein by reference, discloses a method of reducing the wettability of non-vitreous surfaces, and ink jet recording heads including a surface having reduced wettability, wherein a layer of cured siloxane is formed on the non-vitreous surface and a layer derived from at least one fluorosilane is formed on the siloxane layer.

While known compositions and processes are suitable for their intended purposes, a need remains for improved ink jet printheads. In addition, a need remains for ink jet printheads having front faces or nozzle plates with improved ink repellency. Further, a need remains for ink jet printheads with ink repellent coatings that are abrasion resistant and do not wear off rapidly under the action of a wiper blade typically employed in the maintenance station of a ink jet printer. Additionally, a need remains for ink jet printheads having ink repellent coatings that can be deposited onto the nozzle plate or front face without being deposited in or on the ink channels. There is also a need for ink jet printheads having ink repellent coatings on the front faces or nozzle plates thereof, wherein the coatings adhere well to the printheads. In addition, a need remains for ink jet printheads having ink repellent coatings on the front faces or nozzle plates thereof, wherein the coatings are mechanically strong and resistant to abrasion. Further, a need remains for processes for preparing improved ink jet printheads. Additionally, a need remains for processes for modifying the surface characteristics of the front faces or nozle plates of ink jet printheads. There is also a need for processes for modifying the surface characteristics of the front faces or nozzle plates of ink jet printheads by applying ink repellent coatings or layers thereon, wherein the thickness of the coating or layer can be controlled. In addition, there is a need for ink jet printheads having ink repellent coatings or layers on the front faces or nozzle plates thereof that exhibit good adhesion and abrasion resistance when subjected to cleaning or wiping. Further, there is a need for ink jet printheads having relatively thick ink repellent coatings or layers on the front faces or nozzle plates thereof. Additionally, there is a need for ink jet printheads having ink repellent coatings or layers on the front faces or nozzle plates thereof that are covalently bonded to the printhead.

SUMMARY OF THE INVENTION

The present invention is directed to an ink jet printhead comprising a plurality of channels, wherein the channels are capable of being filled with ink from an ink supply and wherein the channels terminate in nozzles on one surface of the printhead, said surface having covalently bonded thereto a coating of an organosiloxane polymer, said organosiloxane polymer coating being substantially uniform with no additional layers thereover. Another embodiment of the present invention is directed to a process for preparing a printhead suitable for ink jet printing which comprises (a) providing an ink jet printhead comprising a plurality of channels, wherein the channels are capable of being filled with ink from an ink supply and wherein the channels terminate in nozzles on one surface of the printhead; (b) applying to said surface a coating of a composition comprising an organosiloxane polymer precursor material; and (c) exposing said organosiloxane precursor material to ultraviolet radiation, thereby causing polymerization, chain extension, and/or crosslinking of the precursor material and covalent bonding of the polymerized, chain extended, and/or crosslinked organosiloxane polymer thereby formed to the surface, said polymerized, chain extended, and/or crosslinked organosiloxane polymer coating being substantially uniform with no additional layers thereover. Yet another embodiment of the present invention is directed to a printing process which comprises (1) providing an ink jet printer containing a printhead comprising a plurality of channels, wherein the channels are capable of being filled with ink from an ink supply and wherein the channels terminate in nozzles on one surface of the printhead, said surface having covalently bonded thereto a coating of an organosiloxane polymer, said organosiloxane polymer coating being substantially uniform with no additional layers thereover; (2) incorporating into the printer an ink composition; and (3) causing droplets of the ink to be ejected in an imagewise pattern onto a recording sheet to form an image.

DETAILED DESCRIPTION OF THE INVENTION

Printheads according to the present invention have on the surface thereof a coating or layer of an organosiloxane homopolymer or copolymer, including copolymers of two or more different organosiloxane monomers and copolymers of one or more organosiloxane monomers with one or more nonorganosiloxane monomers (hereinafter all collectively referred to as organosiloxane polymers or polyorganosiloxanes). The printheads of the present invention can be of any suitable configuration. Regardless of configuration, the polyorganosiloxane polymer coating is outermost or topmost or most external in the printhead structure, in that no additional layers or structures are coated thereon; the polyorganosiloxane polymer coating is the structure outermost or topmost or most external with respect to the openings or orifices through which ink droplets are ejected. Stated another way, the outermost or topmost or external surface of the printhead which defines the nozzles, orifices, or openings has thereover a substantially uniform coating of the polyorganosiloxane, with no additional coatings thereover.

Figure 1:
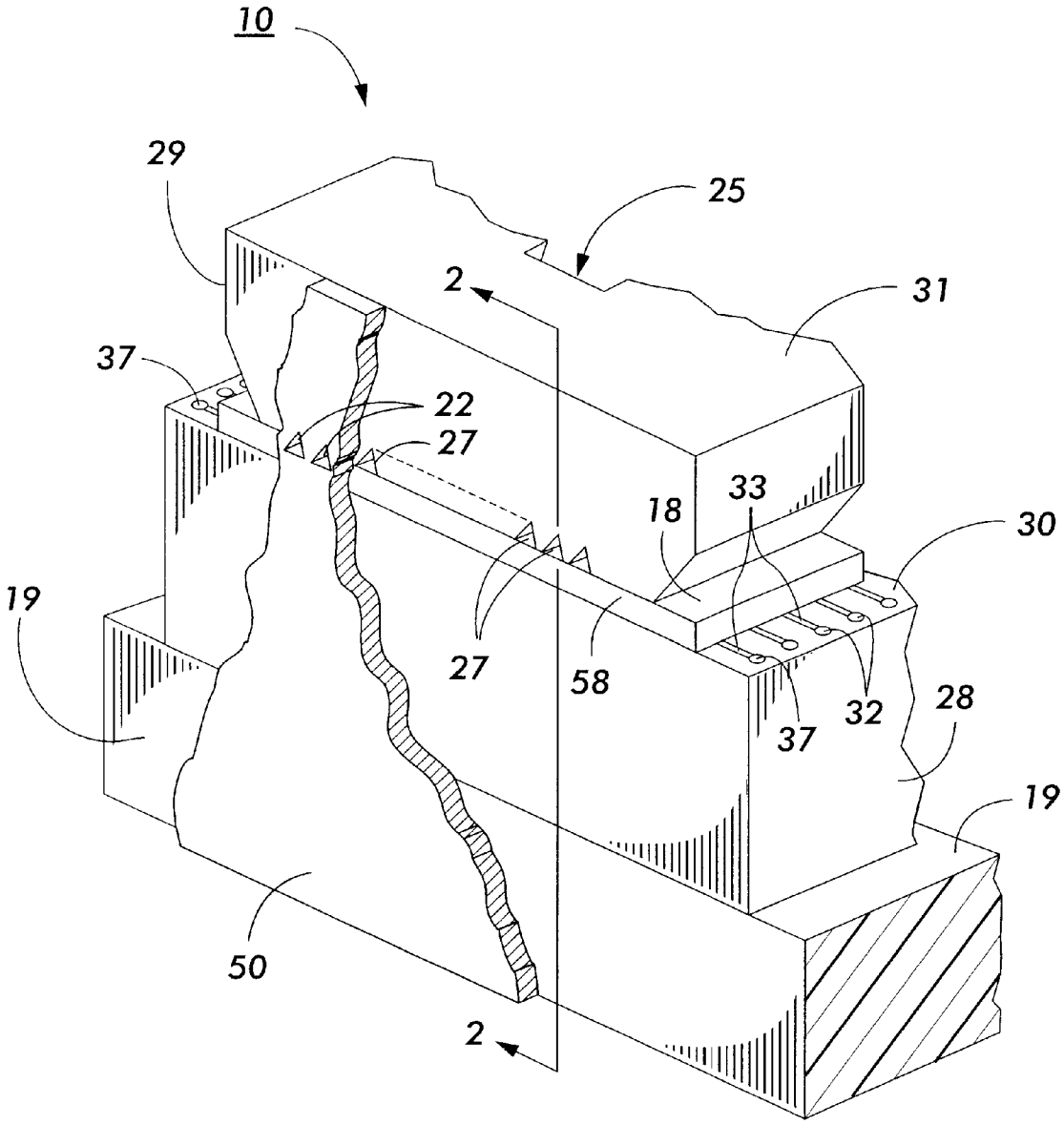
FIG. 1 is an enlarged schematic isometric view of an example of a printhead mounted on a daughter board showing the droplet emitting nozzles.
Figure 2:
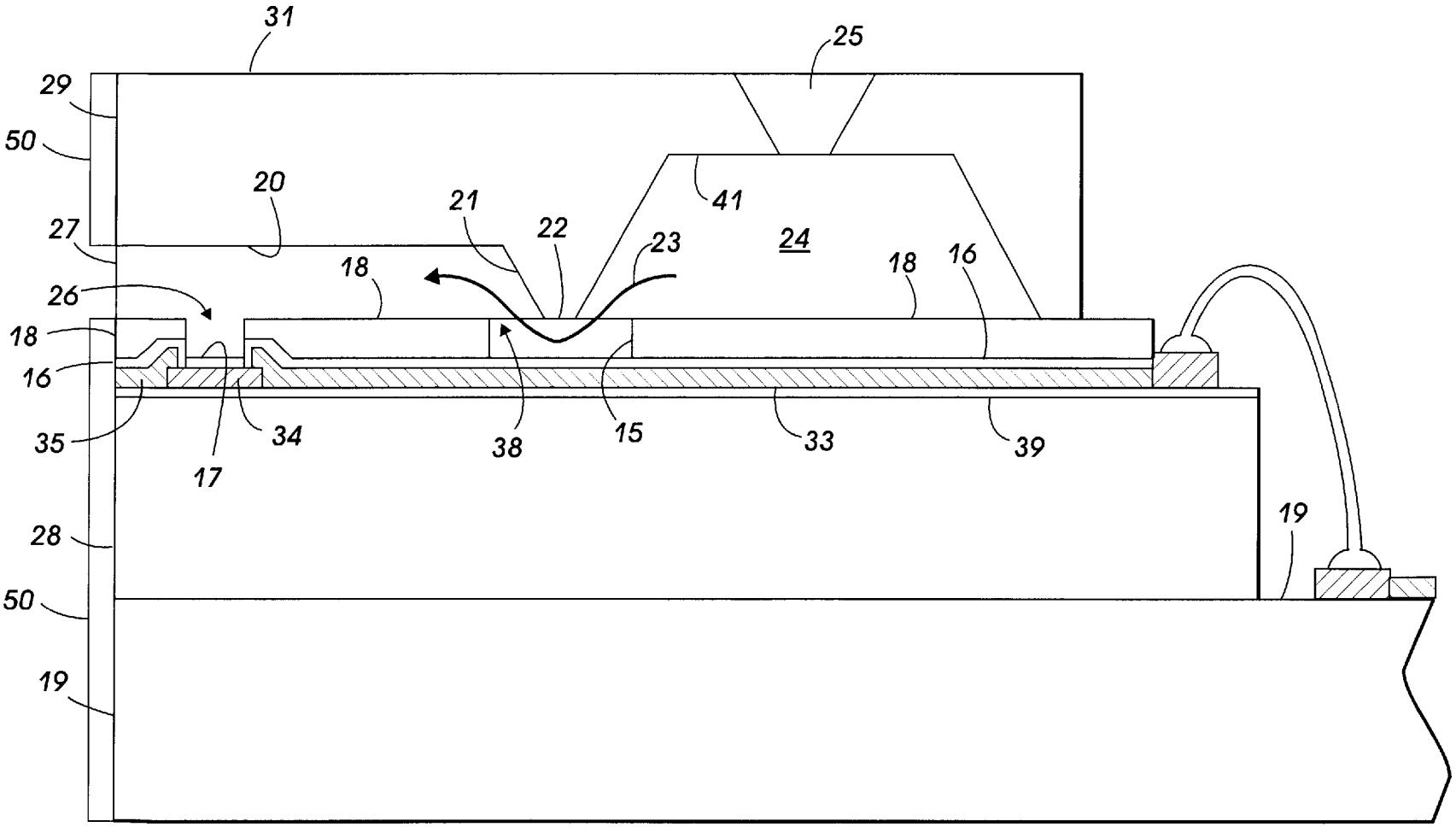
FIG. 2 is an enlarged cross-sectional view of FIG. 1 as viewed along the line 2—2 thereof and showing the electrode passivation and ink flow path between the manifold and the ink channels.

One example of a suitable configuration, suitable in this instance for thermal ink jet printing, is illustrated schematically in FIG. 1, which depicts an enlarged, schematic isometric view of the front face 29 of a printhead 10 showing the array of droplet emitting nozzles 27. Referring also to FIG. 2, discussed later, the lower electrically insulating substrate or heating element plate 28 has the heating elements 34 and addressing electrodes 33 patterned on surface 30 thereof, while the upper substrate or channel plate 31 has parallel grooves 20 which extend in one direction and penetrate through the upper substrate front face edge 29. The other end of grooves 20 terminate at slanted wall 21, the floor 41 of the internal recess 24 which is used as the ink supply manifold for the capillary filled ink channels 20, has an opening 25 therethrough for use as an ink fill hole. The surface of the channel plate with the grooves are aligned and bonded to the heater plate 28, so that a respective one of the plurality of heating elements 34 is positioned in each channel, formed by the grooves and the lower substrate or heater plate. Ink enters the manifold formed by the recess 24 and the lower substrate 28 through the fill hole 25 and by capillary action, fills the channels 20 by flowing through an elongated recess 38 formed in the thick film insulative layer 18. The ink at each nozzle forms a meniscus, the surface tension of which prevents the ink from weeping therefrom. The addressing electrodes 33 on the lower substrate or channel plate 28 terminate at terminals 32. The upper substrate or channel plate 31 is smaller than that of the lower substrate in order that the electrode terminals 32 are exposed and available for wire bonding to the electrodes on the daughter board 19, on which the printhead 10 is permanently mounted. Layer 18 is a thick film passivation layer, discussed later, sandwiched between the upper and lower substrates. This layer is etched to expose the heating elements, thus placing them in a pit, and is etched to form the elongated recess to enable ink flow between the manifold 24 and the ink channels 20. In addition, the thick film insulative layer is etched to expose the electrode terminals.

A cross sectional view of FIG. 1 is taken along view line 2—2 through one channel and shown as FIG. 2 to show how the ink flows from the manifold 24 and around the end 21 of the groove 20 as depicted by arrow 23. As is disclosed in U.S. Pat. Nos. 4,638,337, 4,601,777, and U.S. Patent Re. 32,572, the disclosures of each of which are totally incorporated herein by reference, a plurality of sets of bubble generating heating elements 34 and their addressing electrodes 33 can be patterned on the polished surface of a single side polished (100) silicon wafer. Prior to patterning, the multiple sets of printhead electrodes 33, the resistive material that serves as the heating elements 34, and the common return 35, the polished surface of the wafer is coated with an underglaze layer 39 such as silicon dioxide, having a typical thickness of from about 5,000 Angstroms to about 2 microns, although the thickness can be outside this range. The resistive material can be a doped polycrystalline silicon, which can be deposited by chemical vapor deposition (CVD) or any other well known resistive material such as zirconium boride ($ZrB_2$). The common return and the addressing electrodes are typically aluminum leads deposited on the underglaze and over the edges of the heating elements. The common return ends or terminals 37 and addressing electrode terminals 32 are positioned at predetermined locations to allow clearance for wire bonding to the electrodes (not shown) of the daughter board 19, after the channel plate 31 is attached to make a printhead. The common return 35 and the addressing electrodes 33 are deposited to a thickness typically of from about 0.5 to about 3 microns, although the thickness can be outside this range, with the preferred thickness being 1.5 microns.

If polysilicon heating elements are used, they may be subsequently oxidized in steam or oxygen at a relatively high temperature, typically about 1,100° C. although the temperature can be above or below this value, for a period of time typically of from about 50 to about 80 minutes, although the time period can be outside this range, prior to the deposition of the aluminum leads, in order to convert a small portion of the polysilicon to $SiO_2$. In such cases, the heating elements are thermally oxidized to achieve an overglaze (not shown) of $SiO_2$ with a thickness typically of from about 500 Angstroms to about 1 micron, although the thickness can be outside this range, which has good integrity with substantially no pinholes.

In one embodiment, polysilicon heating elements are used and an optional silicon dioxide thermal oxide layer 17 is grown from the polysilicon in high temperature steam. The thermal oxide layer is typically grown to a thickness of from about 0.5 to about 1 micron, although the thickness can be outside this range, to protect and insulate the heating elements from the conductive ink. The thermal oxide is removed at the edges of the polysilicon heating elements for attachment of the addressing electrodes and common return, which are then patterned and deposited. If a resistive material such as zirconium boride is used for the heating elements, then other suitable well known insulative materials can be used for the protective layer thereover. Before electrode passivation, a tantalum (Ta) layer (not shown) can be optionally deposited, typically to a thickness of about 1 micron, although the thickness can be above or below this value, on the heating element protective layer 17 for added protection thereof against the cavitational forces generated by the collapsing ink vapor bubbles during printhead operation. The tantalum layer is etched off all but the protective layer 17 directly over the heating elements using, for example, $CF_4/O_2$ plasma etching. For polysilicon heating elements, the aluminum common return and addressing electrodes typically are deposited on the underglaze layer and over the opposing edges of the polysilicon heating elements which have been cleared of oxide for the attachment of the common return and electrodes.

For electrode passivation, a film 16 is deposited over the entire wafer surface, including the plurality of sets of heating elements and addressing electrodes. The passivation film 16 provides an ion barrier which will protect the exposed electrodes from the ink. Examples of suitable ion barrier materials for passivation film 16 include polyimide, plasma nitride, phosphorous doped silicon dioxide, materials disclosed herein as being suitable for insulative layer 18, and the like, as well as any combinations thereof. An effective ion barrier layer is generally achieved when its thickness is from about 1000 Angstroms to about 10 microns, although the thickness can be outside this range. In 300 dpi printheads, passivation layer 16 preferably has a thickness of about 3 microns, although the thickness can be above or below this value. In 600 dpi printheads, the thickness of passivation layer 16 preferably is such that the combined thickness of layer 16 and layer 18 is about 25 microns, although the thickness can be above or below this value. The passivation film or layer 16 is etched off of the terminal ends of the common return and addressing electrodes for wire bonding later with the daughter board electrodes. This etching of the silicon dioxide film can be by either the wet or dry etching method. Alternatively, the electrode passivation can be by plasma deposited silicon nitride ($SI_3N_4$).

Next, a thick film type insulative layer 18, of a photopatternable material such as Riston®, Vacrel®, Probimer®, polyimide, photoactive polyarylene ether ketones, or the like, is formed on the passivation layer 16, typically having a thickness of from about 10 to about 100 microns and preferably in the range of from about 15 to about 50 microns, although the thickness can be outside these ranges. The insulative layer 18 is photolithographically processed to enable etching and removal of those portions of the layer 18 over each heating element (forming recesses 26), the elongated recess 38 for providing ink passage from the manifold 24 to the ink channels 20, and over each electrode terminal 32, 37. The elongated recess 38 is formed by the removal of this portion of the thick film layer 18. Thus, the passivation layer 16 alone protects the electrodes 33 from exposure to the ink in this elongated recess 38. Optionally, if desired, insulative layer 18 can be applied as a series of thin layers of either similar or different composition. Typically, a thin layer is deposited, photoexposed, partially cured, followed by deposition of the next thin layer, photoexposure, partial curing, and the like.

Figure 3:
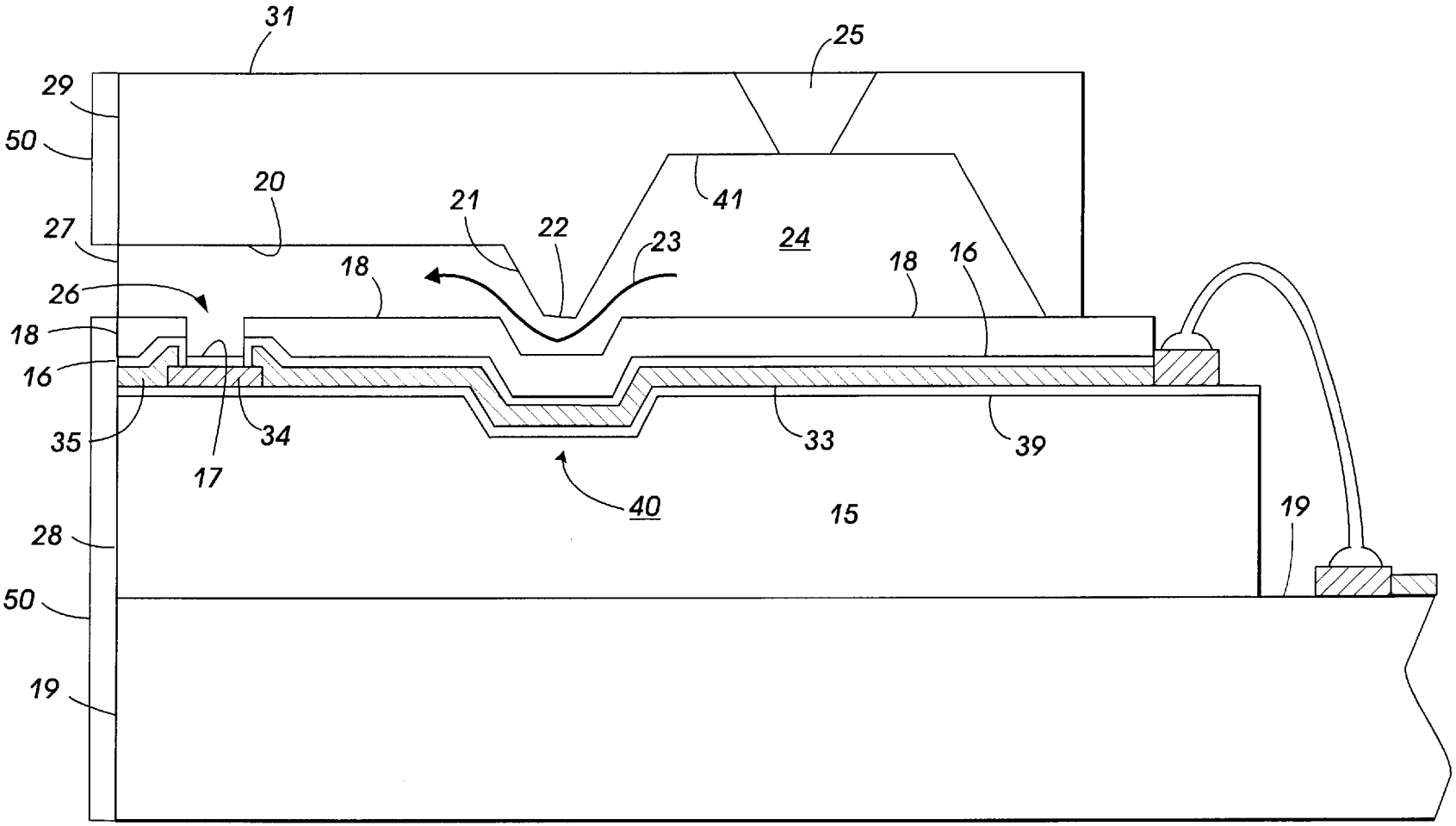
FIG. 3 is an enlarged cross-sectional view of an alternate embodiment of the printhead in FIG. 1 as viewed along the line 2—2 thereof.

FIG. 3 is a similar view to that of FIG. 2 with a shallow anisotropically etched groove 40 in the heater plate, which is silicon, prior to formation of the underglaze 39 and patterning of the heating elements 34, electrodes 33 and common return 35. This recess 40 permits the use of only the thick film insulative layer 18 and eliminates the need for the usual electrode passivating layer 16. Since the thick film layer 18 is impervious to water and relatively thick (typically from about 20 to about 40 microns, although the thickness can be outside this range), contamination introduced into the circuitry will be much less than with only the relatively thin passivation layer 16 well known in the art. The heater plate is a fairly hostile environment for integrated circuits. Commercial ink generally entails a low attention to purity. As a result, the active part of the heater plate will be at elevated temperature adjacent to a contaminated aqueous ink solution which undoubtedly abounds with mobile ions. In addition, it is generally desirable to run the heater plate at a voltage of from about 30 to about 50 volts, so that there will be a substantial field present. Thus, the thick film insulative layer 18 provides improved protection for the active devices and provides improved protection, resulting in longer operating lifetime for the heater plate.

When a plurality of lower substrates 28 are produced from a single silicon wafer, at a convenient point after the underglaze is deposited, at least two alignment markings (not shown) preferably are photolithographically produced at predetermined locations on the lower substrates 28 which make up the silicon wafer. These alignment markings are used for alignment of the plurality of upper substrates 31 containing the ink channels. The surface of the single sided wafer containing the plurality of sets of heating elements is bonded to the surface of the wafer containing the plurality of ink channel containing upper substrates subsequent to alignment.

As disclosed in U.S. Pat. Nos. 4,601,777 and 4,638,337, the disclosures of each of which are totally incorporated herein by reference, the channel plate is formed from a two side polished, (100) silicon wafer to produce a plurality of upper substrates 31 for the printhead. After the wafer is chemically cleaned, a pyrolytic CVD silicon nitride layer (not shown) is deposited on both sides. Using conventional photolithography, a via for fill hole 25 for each of the plurality of channel plates 31 and at least two vias for alignment openings (not shown) at predetermined locations are printed on one wafer side. The silicon nitride is plasma etched off of the patterned vias representing the fill holes and alignment openings. A potassium hydroxide (KOH) anisotropic etch can be used to etch the fill holes and alignment openings. In this case, the (111) planes of the (100) wafer typically make an angle of about 54.7 degrees with the surface of the wafer. The fill holes are small square surface patterns, generally of about 20 mils (500 microns) per side, although the dimensions can be above or below this value, and the alignment openings are from about 60 to about 80 mils (1.5 to 3 millimeters) square, although the dimensions can be outside this range. Thus, the alignment openings are etched entirely through the 20 mil (0.5 millimeter) thick wafer, while the fill holes are etched to a terminating apex at about halfway through to three-quarters through the wafer. The relatively small square fill hole is invariant to further size increase with continued etching so that the etching of the alignment openings and fill holes are not significantly time constrained.

Next, the opposite side of the wafer is photolithographically patterned, using the previously etched alignment holes as a reference to form the relatively large rectangular recesses 24 and sets of elongated, parallel channel recesses that will eventually become the ink manifolds and channels of the printheads. The surface 22 of the wafer containing the manifold and channel recesses are portions of the original wafer surface (covered by a silicon nitride layer) on which an adhesive, such as a thermosetting epoxy, will be applied later for bonding it to the substrate containing the plurality of sets of heating elements. The adhesive is applied in a manner such that it does not run or spread into the grooves or other recesses. The alignment markings can be used with, for example, a vacuum chuck mask aligner to align the channel wafer on the heating element and addressing electrode wafer. The two wafers are accurately mated and can be tacked together by partial curing of the adhesive. Alternatively, the heating element and channel wafers can be given precisely diced edges and then manually or automatically aligned in a precision jig. Alignment can also be performed with an infrared aligner-bonder, with an infrared microscope using infrared opaque markings on each wafer to be aligned, or the like. The two wafers can then be cured in an oven or laminator to bond them together permanently. The channel wafer can then be milled to produce individual upper substrates. A final dicing cut, which produces end face 29, opens one end of the elongated groove 20 producing nozzles 27. The other ends of the channel groove 20 remain closed by end 21. However, the alignment and bonding of the channel plate to the heater plate places the ends 21 of channels 20 directly over elongated recess 38 in the thick film insulative layer 18 as shown in FIG. 2 or directly above the recess 40 as shown in FIG. 3 enabling the flow of ink into the channels from the manifold as depicted by arrows 23. The plurality of individual printheads produced by the final dicing are bonded to the daughter board and the printhead electrode terminals are wire bonded to the daughter board electrodes.

As shown in FIGS. 1, 2, and 3, coating 50 is a water repellent and ink repellent polyorganosiloxane coating . As shown in FIG. 1, the coating is partially cut away to show other components of the printhead front face 29. Typical coating thicknesses are from about 0.1 to about 100 microns, preferably from about 0.1 to about 20 microns, and more preferably from about 0.1 to about 10 microns, although the thickness can be outside of these ranges.

Figure 4:
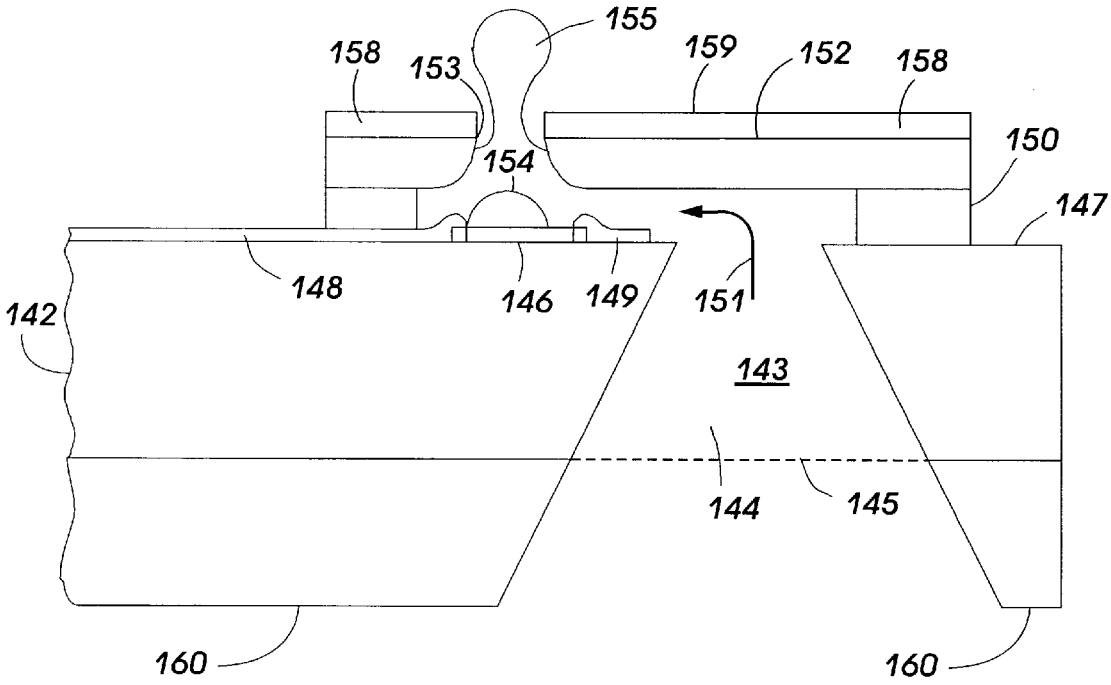
FIG. 4 is a schematic cross-sectional view of a typical roofshooter-type thermal ink jet printhead.

A typical roofshooter-type thermal ink jet printhead is shown in FIG. 4. As shown, heater plate 142 is mounted on heat sinking substrate 160. In this configuration, the silicon heater plate 142 has a reservoir or feed slot 143 etched therethrough. The inlet 44 is covered by filter 145. An array of heating elements 146 are patterned on heater plate surface 147 near the open bottom of reservoir 143. The heating elements are selectively addressed via passivated addressing electrodes 148 and common return 149 (passivated layer not shown). A flow directing layer 150 is patterned to form flow paths for the ink from the reservoir to a location above the heating elements as shown by arrow 151. A nozzle plate 152 containing nozzles 153 is aligned and bonded to flow directing layer 150 so that the nozzles are directly above the heating elements. An electrical signal applied to the heating element temporarily vaporizes the ink and forms droplet ejecting bubbles 154 which eject droplet 155 in a direction normal to the heating element. Water repellent and ink repellent polyorganosiloxane coating 158 is situated on outer surface 159 of nozzle plate 152.

Figure 5:
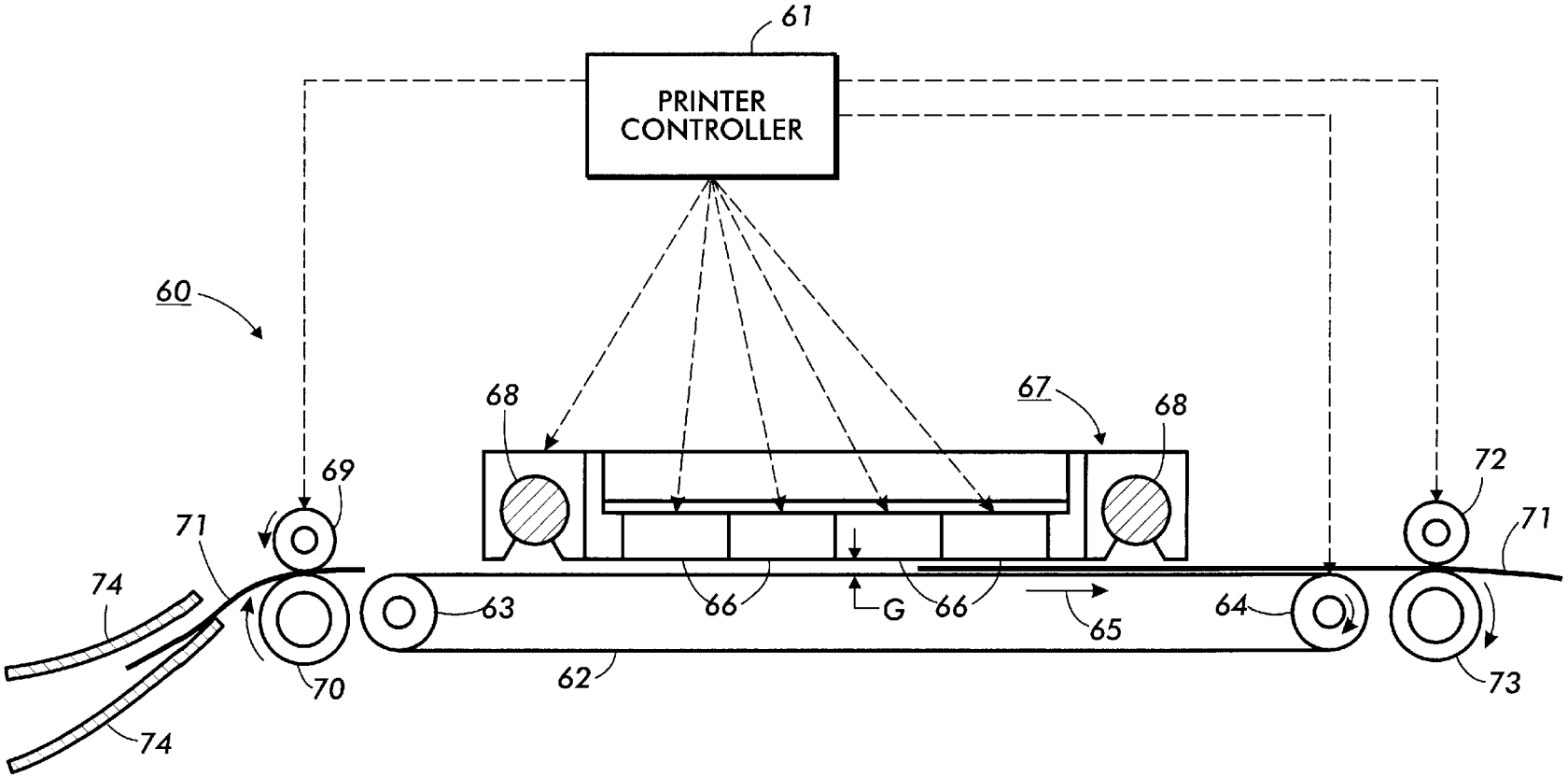
FIG. 5 is a schematic, partially shown side elevation view of an acoustic ink jet printer useful for the present invention.

In FIG. 5, a partially shown side elevation view of an acoustic ink jet printer 60 is depicted. The printer has a printer controller 61, a transport belt 62 entrained on idler roller 63 and drive roller 64 for movement in the direction of arrow 65, a plurality of acoustic ink jet printheads 66 mounted on a carriage 67 which is translatable along guide rails 68 in a direction orthogonal to the direction of the printhead carriage, and a pair of input feed rollers 69 and 70 forming a nip therebetween for registering and feeding a recording medium 71, such as a sheet of paper, on to the transport belt. A pair of output feed rollers 72 and 73 drive the recording medium from the transport belt, so that the recording medium is always in the grip of either the feed rollers or the output rollers.

The printer controller 61 directly communicates with and controls the input feed rollers 69 and 70, which accept the recording medium from the input tray (not shown) after the recording medium exits from a pair of guides 74 which direct the recording medium to the input feed rollers. Printer controller 61 also directly communicates with and controls the movement of the transport belt via a stepper motor (not shown). In the illustrated embodiment, the acoustic ink jet printheads are translatable, partial width printheads, one printhead for each of the liquids to be dispensed onto the recording medium, and the transport belt is held stationary by the printer controller while the printheads print a swath of an image. The transport belt is then stepped a distance equal to the height of the printed swath or a portion thereof until the entire image is printed. Other embodiments are possible, including an embodiment in which the printheads are pagewidth and fixed and the transport belt is moved relative to the printheads at a constant velocity. The printer controller 61 directly communicates with and controls the acoustic ink droplet ejectors 75 (see FIG. 6) in each of the acoustic printheads.

Figure 6:
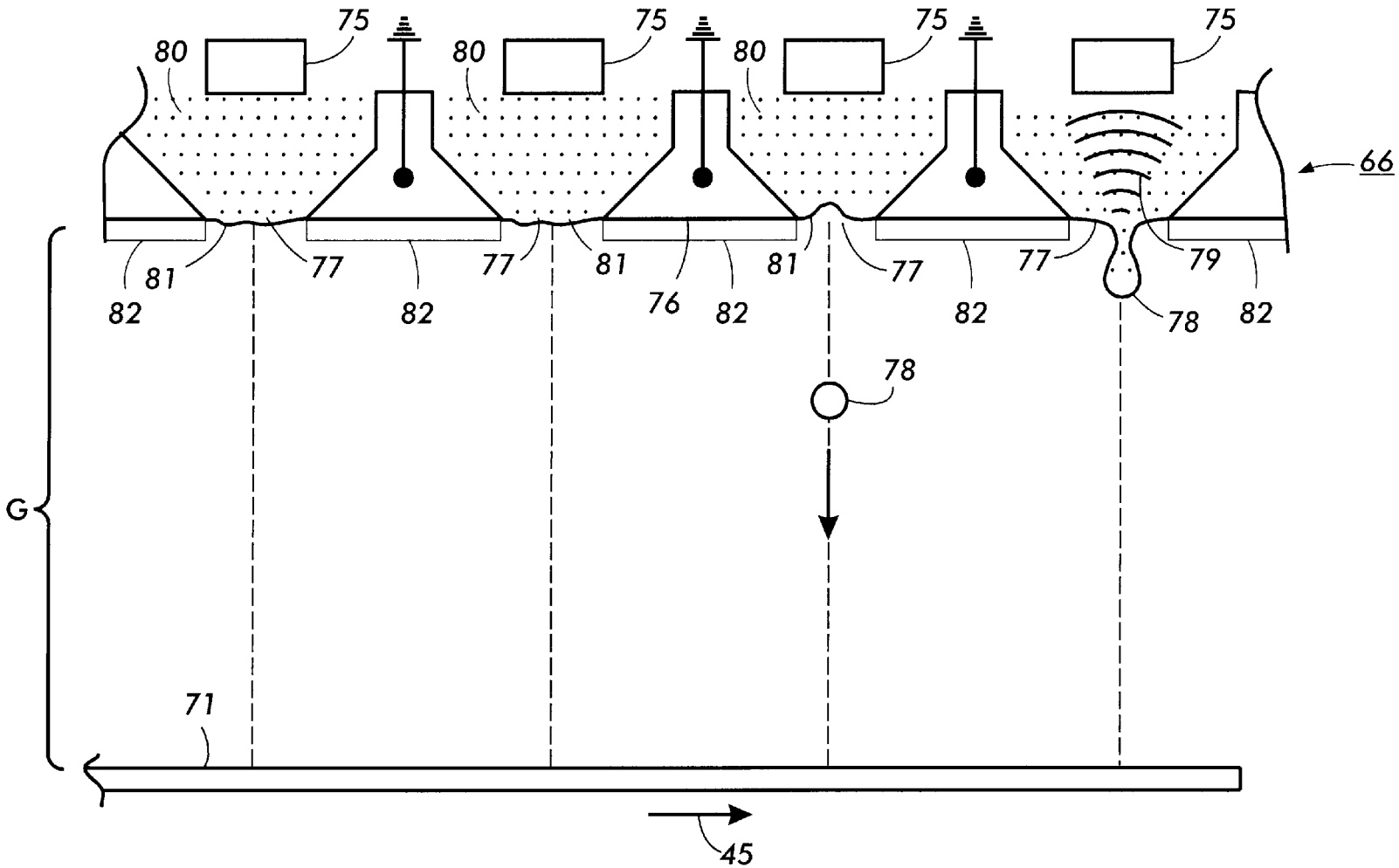
FIG. 6 is a schematic representation of an acoustic ink jet printhead used in the apparatus of FIG. 5 and showing ink droplets moving toward a recording medium on the transport belt.

Referring to FIG. 6, a schematic representation of the apparatus is shown in an enlarged cross-sectional view of a portion of the printhead 66, the transport belt 62 with the recording medium 71 thereon, and the gap "G" between the face 76 of the printhead having the apertures 77 therein and the transport belt. The printhead 66 ejects ink droplets 78 through the printhead apertures 77 directed toward the recording medium 71 using acoustic ink droplet ejectors 75. Each acoustic ink droplet ejector includes a piezoelectric transducer of RF source which creates a sound wave 79 in the ink 80 stored in the printhead. A lens (not shown), such as a Fresnel lens, focuses the sound wave at the ink surface 81 in the apertures 77. The acoustic pressure at the ink surface 81 causes an ink droplet 78 to form. The fully formed and ejected droplet 78 is directed and propelled towards the recording medium 71. Water repellent and ink repellent polyorganosiloxane coating 82 is situated on the outer surface of face 76.

Figure 7:
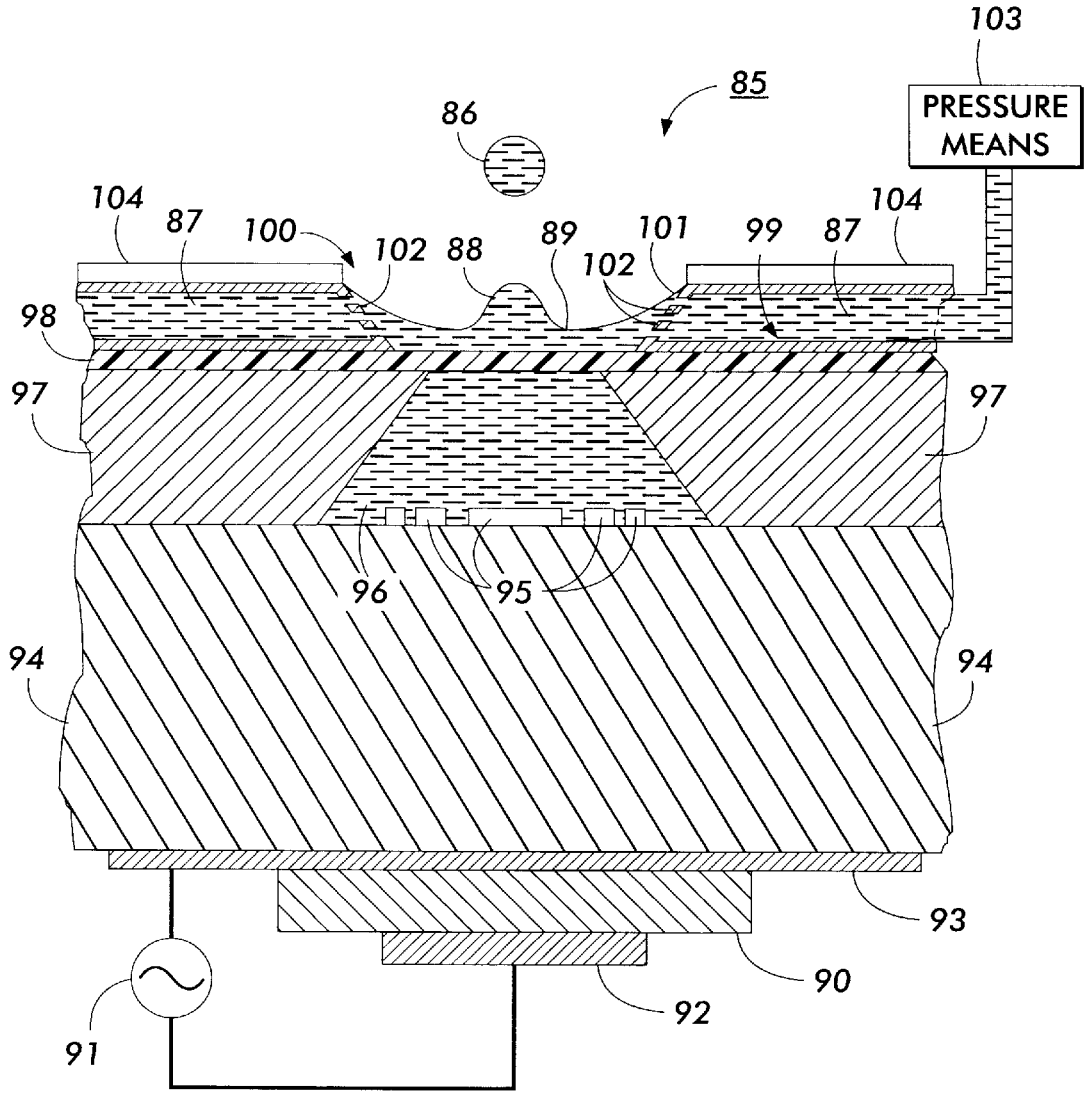
FIG. 7 is an unscaled, cross-sectional view of a first embodiment acoustic droplet ejector which is shown ejecting a droplet of a marking fluid.

Refer now to FIG. 7 for an illustration of an exemplary acoustic droplet ejector 85. FIG. 7 shows the droplet ejector 85 shortly after ejection of a droplet 86 of marking fluid 87 and before the mound 88 on the free surface 89 of the marking fluid 87 has relaxed. As droplets are ejected from such mounds, mound relaxation and subsequent formation are prerequisites to the ejection of other droplets.

The forming of the mound 88 and the ejection of the droplet 86 are the results of pressure exerted by acoustic forces created by a ZnO transducer 90. To generate the acoustic pressure, RF drive energy is applied to the ZnO transducer 90 from an RF driver source 91 via a bottom electrode 92 and a top electrode 93. The acoustic energy from the transducer passes through a base 94 into an acoustic lens 95. The acoustic lens focuses its received acoustic energy into a small focal area which is at, or is near, the free surface 89 of the marking fluid 87. Provided that the energy of the acoustic beam is sufficient and properly focused relative to the free surface 89 of the marking fluid, a mound 88 is formed and a droplet 86 is ejected.

Suitable acoustic lenses can be fabricated in many ways, for example, by first depositing a suitable thickness of an etchable material on the substrate. Then, the deposited material can be etched to create the lenses. Alternatively, a master mold can be pressed into the substrate at the location where the lenses are desired. By heating the substrate to its softening temperature acoustic lenses are created.

Still referring to FIG. 7, the acoustic energy from the acoustic lens 95 passes through a liquid cell 96 filled with a liquid (such as water) having a relatively low attenuation. The bottom of the liquid cell 96 is formed by the base 94, the sides of the liquid cell are formed by surfaces of an aperture in a top plate 97, and the top of the liquid cell is sealed by an acoustically thin capping structure 98. By "acoustically thin" it is implied that the thickness of the capping structure is less than the wavelength of the applied acoustic energy.

The droplet ejector 85 further includes a reservoir 99, located over the capping structure 98, which holds marking fluid 87. As shown in FIG. 7, the reservoir includes an opening 100 defined by sidewalls or liquid level control plate 101. It should be noted that the opening 100 is axially aligned with the liquid cell 96. The side walls 101 include a plurality of portholes 102 through which the marking fluid passes. A pressure means 103 forces marking fluid 87 through the portholes 102 so as to create a pool of marking fluid having a free surface over the capping structure 98.

The droplet ejector 85 is dimensioned such that the free surface 89 of the marking fluid is at, or is near, the acoustic focal area. Since the capping structure 98 is acoustically thin, the acoustic energy readily passes through the capping structure and into the overlaying marking fluid. Water repellent and ink repellent polyorganosiloxane coating 104 is situated on the outer surface of sidewalls or liquid level control plate 101.

A droplet ejector similar to the droplet ejector 85, including the acoustically thin capping structure and reservoir, is described in U.S. patent application Ser. No. 890,211, filed by Quate et. al. on May 29, 1992, now abandoned, the disclosure of which is totally incorporated herein by reference.

Figure 8:
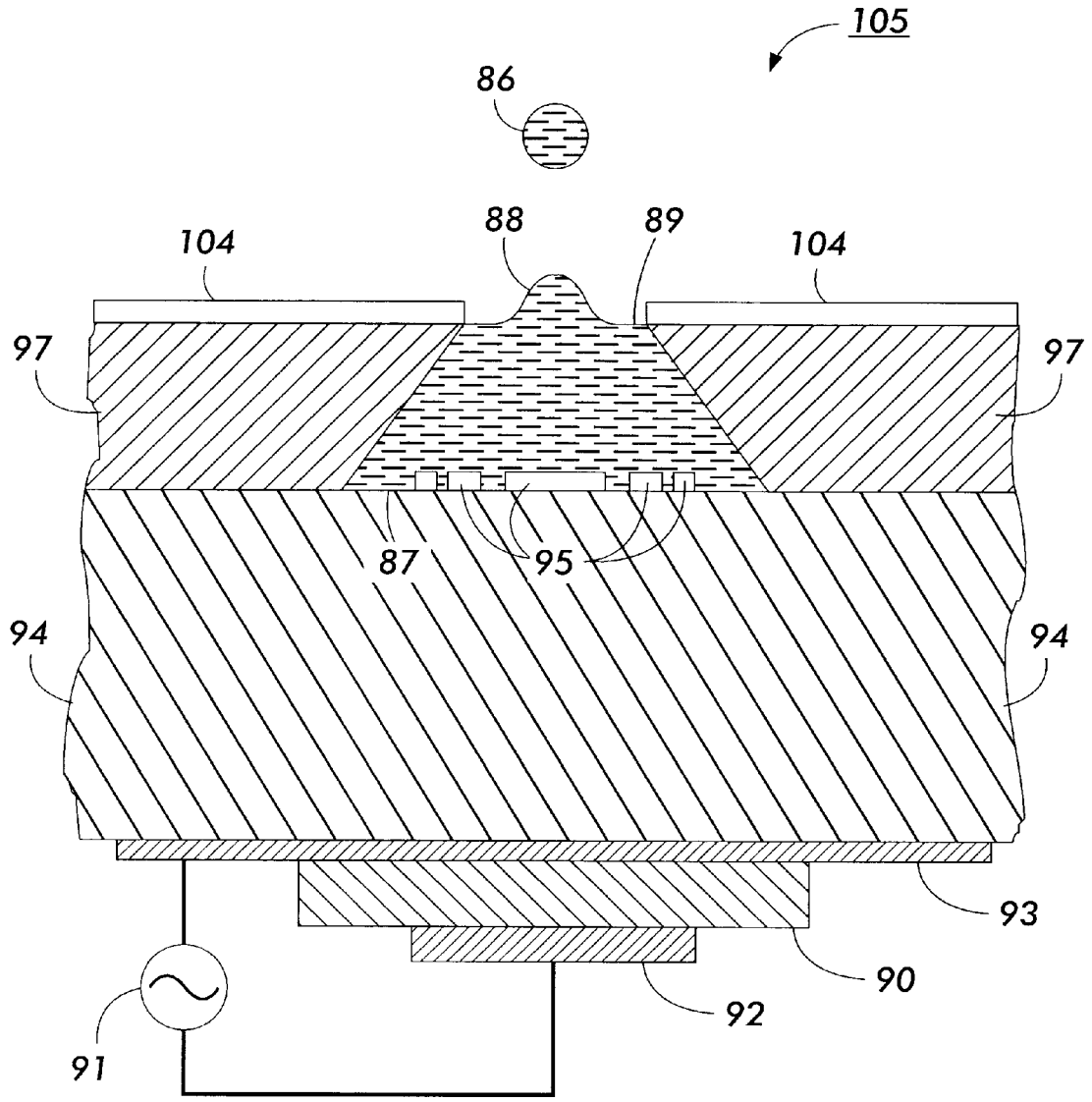
FIG. 8 is an unscaled cross-sectional view of a second embodiment acoustic droplet ejector which is shown ejecting a droplet of a marking fluid.

A second embodiment acoustic droplet ejector 105 is illustrated in FIG. 8. The droplet ejector 105 does not have a liquid cell 96 sealed by an acoustically thin capping structure 98. Nor does it have the reservoir filled with marking fluid 87 nor any of the elements associated with the reservoir. Rather, the acoustic energy passes from the acoustic lens 95 directly into marking fluid 87. However, droplets 86 are still ejected from mounds 88 formed on the free surface 89 of the marking fluid. Water repellent and ink repellent polyorganosiloxane coating 104 is situated on the outer surface of top plate 97.

In general, the polyorganosiloxane coating is situated on the topmost or outermost structure of the acoustic printhead, such as the top plate, side wall, liquid level control plate, or the like.

Figure 9:
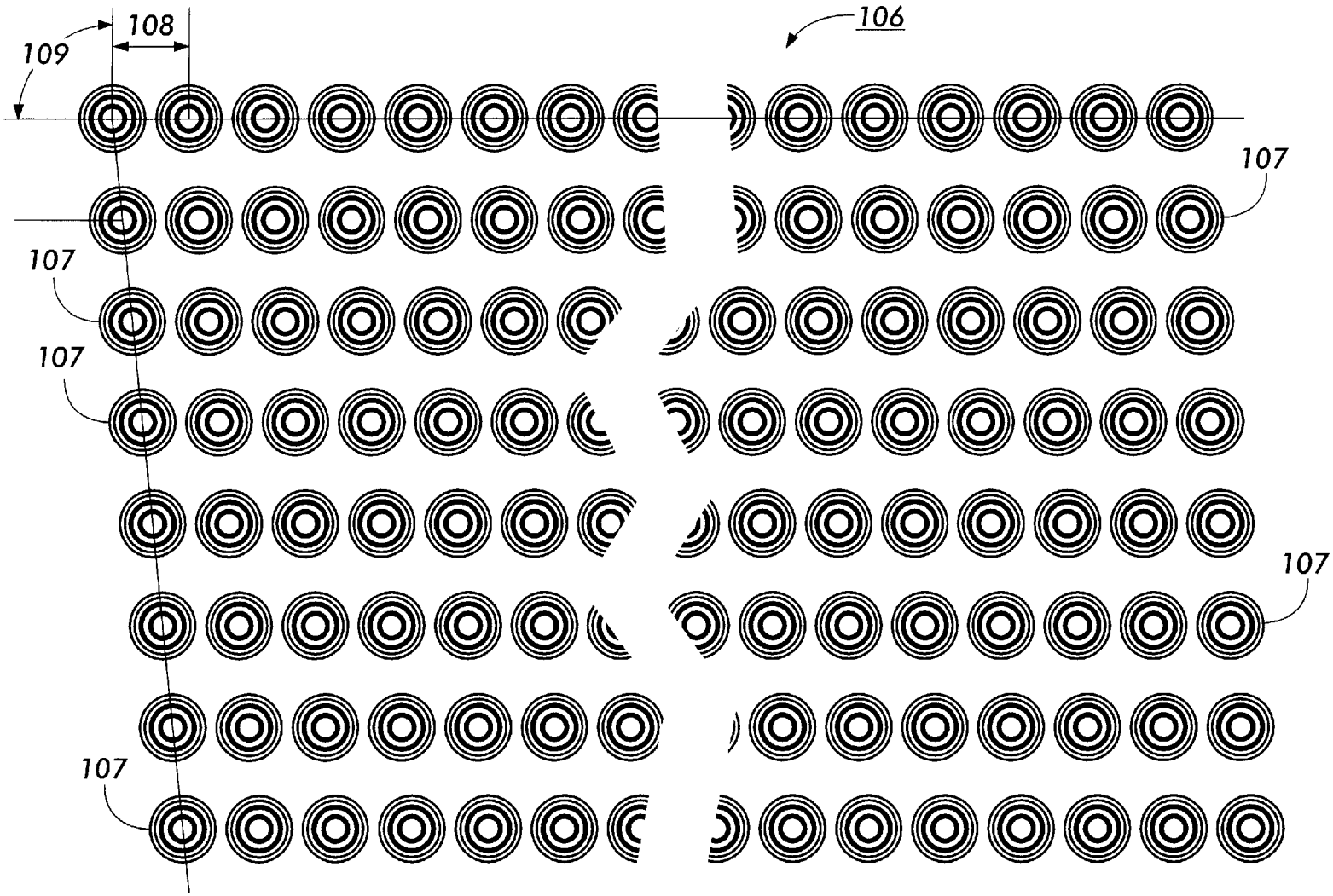
FIG. 9 is an top-down schematic depiction of an array of acoustic droplet ejectors in one ejector unit.

The individual acoustic droplet ejectors 85 and 105 (illustrated in FIGS. 7 and 8, respectively) are usually fabricated as part of an array of acoustic droplet ejectors. FIG. 9 shows a top-down schematic depiction of an array 106 of individual droplet ejectors 107 which is particularly useful in printing applications. Since each droplet ejector 107 is capable of ejecting a droplet with a smaller radius than the droplet ejector itself, and since full coverage of the recording medium is desired, the individual droplet ejectors are arrayed in offset rows. In FIG. 9, each droplet ejector in a given row is spaced a distance 108 from its neighbors. That distance 108 is eight (8) times the diameter of a droplet ejected from a droplet ejector. By offsetting eight (8) rows of droplet ejectors at an angle 109, and by moving the recording medium relative to the rows of droplet ejectors at a predetermined rate, the array 106 can print fully filled in (no gaps between pixels) lines or blocks.

The printheads illustrated in FIGS. 1 through 9 constitute specific embodiments of the present invention. Any other suitable printhead configuration comprising ink-bearing channels terminating in nozzles or other openings on the printhead surface, including thermal ink jet printheads, piezoelectric ink jet printheads, acoustic ink jet printheads, and the like, can also be employed with the materials disclosed herein to form a printhead of the present invention.

The composition containing the precursor or precursors of the crosslinked organosiloxane polymer is then exposed to ultraviolet radiation, preferably from a laser or a lamp, thereby causing crosslinking and/or chain extension of the precursors. Any desired or effective ultraviolet wavelength for radiation can be employed. Typical wavelengths are from about 150 to about 600 nanometers, preferably from about 190 to about 540 nanometers, and more preferably from about 240 to about 360 nanometers, although the wavelength can be outside of these ranges. An excimer laser is a laser containing a noble gas, such as helium or neon, or halides of the noble gases, as its active medium. Excimer lasers are preferred because they produce high average power and relatively pure ultraviolet radiation. Examples of suitable lasers include an ArF laser, which provides radiation at a wavelength of about 193 nanometers, a KrF laser, which provides radiation at a wavelength of about 248 nanometers, a Xenon chloride laser, which provides radiation at about 308 nanometers, and the second and third or fourth harmonic of a neodymium YAG laser, which provides radiation at wavelengths of about 532, 355, and 255 nanometers, respectively. Typically, peak exposure is from about 0.01 Watt to about 17 megaWatts per square centimeter, preferably from about 0.1 Watt to about 10 megawatts per square centimeter, and more preferably from about 0.1 Watt to about 5 megawatts per square centimeter, although the exposure can be outside of these ranges. Typical integrated exposure energy is from about 0.5 to about 300 Joules per square centimeter, preferably from about 0.5 to about 200 Joules per square centimeter, and more preferably from about 0.5 to about 100 joules per square centimeter, although the exposure energy can be outside of these ranges.

The coating layer of the composition containing the precursor(s) to the crosslinked polyorganosiloxane typically has a thickness of from about 0.1 to about 100 microns, preferably from about 0.1 to about 20 microns, and more preferably from about 0.1 to about 10 microns, although the thickness can be outside of these ranges. These values apply both to the layer before crosslinking and the layer after crosslinking, since the thicknesses before and after crosslinking are similar.

The coating layer of the composition containing the crosslinked polyorganosiloxane precursor(s) can be applied to the printhead by any suitable or desired process, such as spin coating, extrusion, dip coating, doctor blade coating, thermal evaporative deposition, or the like. All materials are subjected to UV exposure to polymerize, crosslink, fix, and consolidate the polyorganosiloxane.

Upon irradiation with ultraviolet radiation of the composition containing the precursor(s) to the crosslinked organosiloxane polymer, these precursor monomers, oligomers, or polymers undergo crosslinking and/or chain extension to form a crosslinked polymeric layer. One class of suitable precursor oligomers or polymers for the present invention is that of homopolymers or block or graft copolymers of organosiloxanes. Organosiloxane homopolymers, and the organosiloxane portion of block or graft copolymers, typically are of the general formula

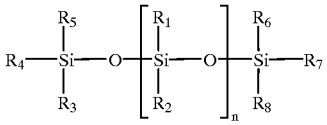

wherein n is an integer representing the number of repeat monomer units. $R_1$, $R_2$, $R_3$, $R_4$, $R_5$, $R_6$, $R_7$, and $R_8$ each, independently of the other, is an alkyl group, including linear, branched, cyclic, and unsaturated alkyl groups, typically with from 1 to about 22 carbons and preferably with from 1 to about 5 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group (with either the alkyl or the aryl portion of the group being attached to the silicon atom), typically with from 7 to about 28 carbon atoms, and preferably with from 7 to about 10 carbon atoms, although the number of carbon atoms can be outside of these ranges. The alkyl, aryl, or arylalkyl groups can, if desired, be substituted with substituents such as halogen atoms, including fluorine, chlorine, and bromine, and iodine, or functional substituents, such as amine groups, carboxylic acid groups, hydroxyl groups, and the like. In one embodiment of the present invention, the alkyl, aryl, or arylalkyl groups are unsubstituted. In another embodiment of the present invention, the alkyl, aryl, or arylalkyl groups are substantially free of fluorine substituents. Specific examples of suitable precursor oligomers and polymers include poly (dimethylsiloxanes), of the general formula

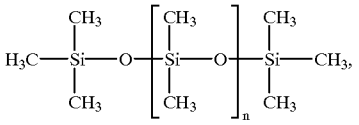

poly(phenylmethylsiloxanes), of the general formula

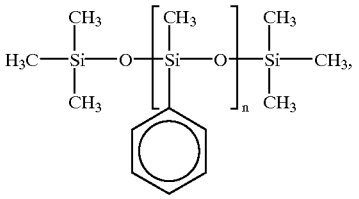

dimethylsiloxane/phenylmethylsiloxane random copolymers, of the general formula

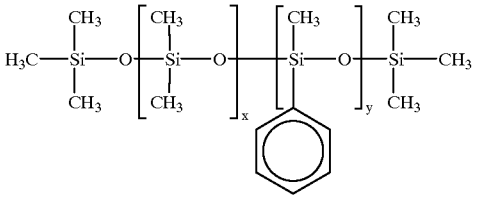

wherein x and y are integers representing the number of repeat monomer units, poly(sesquisiloxanes), of the general formula

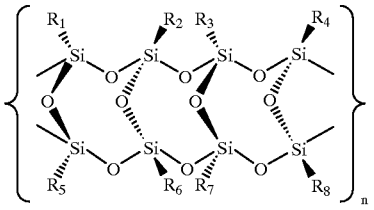

wherein $R_1$, $R_2$, $R_3$, $R_4$, $R_5$, $R_6$, $R_7$, and $R_8$ each, independently of the others, are alkyl groups (as defined above), such as methyl groups, or phenyl groups, and n is an integer representing the number of repeat monomer units, poly(3,3,3-trifluoropropylmethylsiloxanes), of the general formula

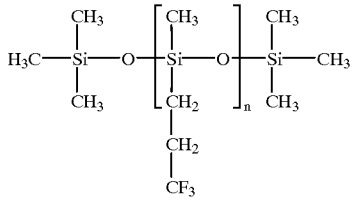

wherein n is an integer representing the number of repeat monomer units, poly(silylphenylenes), of the general formula

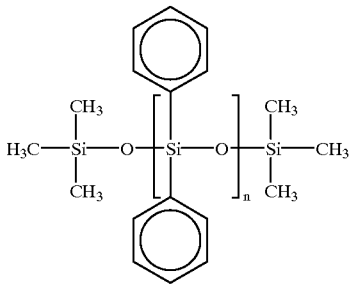

wherein n is an integer representing the number of repeat monomer units, and the like.

Block or graft copolymers of organosiloxanes generally include an organosiloxane segment or portion and at least one other segment or portion, as follows:

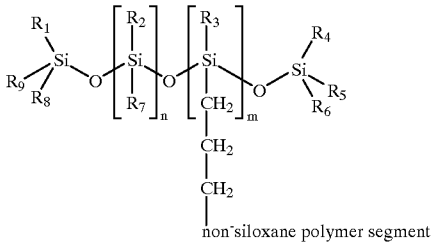

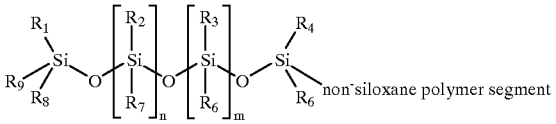

wherein each of $R_1$, $R_2$, $R_3$, $R_4$, $R_5$, $R_6$, $R_7$, $R_8$, and $R_9$, independently of the others, is an alkyl group, including linear, branched, cyclic, and unsaturated alkyl groups, typically with from 1 to about 22 carbon atoms, and preferably with from 1 to about 5 carbon atoms, although the number of carbon atoms can be outside of these ranges, an aryl group, typically with from about 6 to about 12 carbon atoms, although the number of carbon atoms can be outside of this range, or an alkylaryl group (with either the alkyl or the aryl portion of the group being attached to the silicon atom), typically with from about 7 to about 28 carbon atoms, and preferably with from about 7 to about 10 carbon atoms, although the number of carbon atoms can be outside of these ranges. The alkyl, aryl, or arylalkyl groups can, if desired, be substituted with substituents such as halogen atoms, including fluorine, chlorine, and bromine, or functional substituents such as amine groups, carboxylic acid groups, hydroxyl groups, and the like. In one embodiment of the present invention, the alkyl, aryl, or arylalkyl groups are unsubstituted. In another embodiment of the present invention, the alkyl, aryl, or arylalkyl groups are substantially free of fluorine substituents. Examples of suitable hydrophilic non-siloxane segments in organosiloxane block or graft copolymers include materials such as (1) alkylene oxides, including ethylene oxide, propylene oxide, and copolymeric sequences of ethylene oxide and propylene oxide, wherein the hydrophilic portion of the polymer is of the general formula

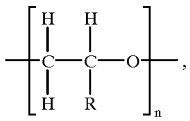

wherein R is hydrogen or methyl and n is an integer representing the number of repeat monomer units, (2) 2-alkyl oxazolines, wherein the hydrophilic portion of the polymer is of the general formula

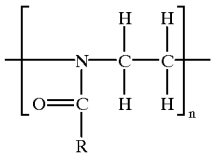

wherein n is an integer representing the number of repeat monomer units, R is an alkyl group, including linear, branched, cyclic, and unsaturated alkyl groups, typically with from 1 to about 22 carbons and preferably with from 1 to about 6 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group, typically with from 7 to about 28 carbon atoms, and preferably with from 7 to about 10 carbon atoms, although the number of carbon atoms can be outside of these ranges, (3) ethylene imine, wherein the hydrophilic portion of the polymer is of the general formula

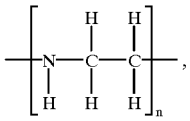

wherein n is an integer representing the number of repeat monomer units, (4) caprolactone, wherein the hydrophilic portion of the polymer is of the general formula

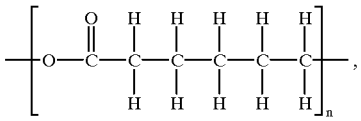

wherein n is an integer representing the number of repeat monomer units, (5) acrylic acid, wherein the hydrophilic portion of the polymer is of the general formula

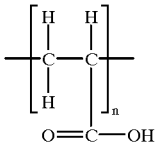

wherein n is an integer representing the number of repeat monomer units, (6) methacrylic acid, wherein the hydrophilic portion of the polymer is of the general formula

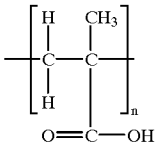

wherein n is an integer representing the number of repeat monomer units, (7) acrylate esters, such as acrylic esters and methacrylic esters, wherein the hydrophilic portion of the polymer is of the general formula

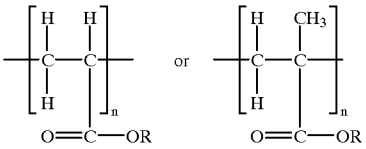

wherein n is an integer representing the number of repeat monomer units, R is an alkyl group, including linear, branched, cyclic, and unsaturated alkyl groups, typically with from 1 to about 22 carbons and preferably with from 1 to about 6 carbon atoms, although the number of carbon atoms can be outside of these ranges, an aryl group, typically with from 6 to about 12 carbon atoms, with 6 carbon atoms being preferred, although the number of carbon atoms can be outside of this range, or an arylalkyl group, typically with from 7 to about 28 carbon atoms, and preferably with from 7 to about 10 carbon atoms, although the number of carbon atoms can be outside of these ranges. These polymers typically contain the organosiloxane monomers in an amount of from about 50 to about 99 percent by weight of the polymer, preferably from about 75 to about 95 percent by weight of the polymer, and contain the polar, hydrophilic monomers in an amount of from about 1 to about 50 percent by weight of the polymer, preferably from about 5 to about 25 percent by weight of the polymer, although the relative amounts of monomers can be outside of these ranges. The number average molecular weight of the polymer typically is from about 1,000 to about 50,000, and preferably from about 2,000 to about 20,000, although the value can be outside of these ranges. Also suitable as non-siloxane segments in organosiloxane block or graft copolymers are vinyl polymers segments, such as poly(styrene) condensation polymer segments, including poly (arylene ethers) and polyimides.

When an organosiloxane copolymer is employed, the ratio of the organosiloxane segment to the non-organosiloxane segment typically is from about 10:90 to about 90:10, preferably from about 50:50 to about 90:10, and more preferably from about 70:30 to about 90:10, although the ratio can be outside of these ranges.

Various crosslinked organosiloxane polymers and copolymers have various advantages. For example, the presence of methyl groups on the silicon atoms of the organosiloxane polymer enable low surface energy of the crosslinked polymer. Block or graft precursor organosiloxane copolymers wherein the comonomers are hydrophilic can be easier to coat onto the printhead than precursor organosiloxane homopolymers because the hydrophilic monomers can be sufficiently polar to enhance wetting of the printhead surface. Different alkyl, aryl, or alkylaryl substituents on the precursor organosiloxane polymers absorb ultraviolet radiation at different wavelengths; for example, dimethylsiloxanes typically absorb most strongly at about 193 nanometers; phenylmethylsiloxanes typically absorb most strongly at about 248 nanometers. Substituted phenylsiloxanes typically absorb most strongly at longer wavelengths.

Organosiloxane precursors suitable for the present invention include commercially available cyclic siloxane monomers, siloxane oils, oligomeric polysiloxanes, and higher molecular weight siloxane polymers. Organosiloxane polymers suitable for the present invention typically have a number average molecular weight ($M_n$) of from about 1,000 to about 100,000, preferably from about 1,000 to about 50,000, and more preferably from about 1,000 to about 20,000, although the value of $M_n$ can be outside these ranges.

The coatings on the printheads of the present invention can be prepared by coating siloxane monomers, oligomers, or polymers onto the printhead, followed by exposure to ultraviolet radiation to crosslink the oligomers or polymers.

Examples of commercially available monomeric siloxanes include 3,3,3-(trifluoropropyl)(methyl) cyclotrisiloxane, octaphenylcyclotetrasiloxane, octamethylcyclotetrasiloxane, triphenyltrimethylcyclotrisiloxane, all of which can be obtained from Gelest, Inc., Tullytown, Pa. Examples of commercially available siloxane oils and polymers include trimethylsiloxy-terminated poly(dimethylsiloxanes) (available from Gelest, Inc., in molecular weights ranging from about 160 to about 400,000), trimethylsiloxy-terminated diphenysiloxane/dimethylsiloxane copolymers (available from Gelest, Inc., in molecular weights of up to about 2,400), trimethylsiloxy-terminated phenylmethylsiloxane homopolymers (available from Gelest, Inc., in molecular weights of from about 350 to about 2,200), trimethylsiloxy-terminated phenymethylsiloxane/dimethylsiloxane copolymers (available from Gelest, Inc., in molecular weights of from about 1,500 to about 2,700), poly(3,3,3-trifluoropropylmethylsiloxanes (available from Gelest, Inc., in molecular weights of from about 900 to about 14,000), and the like. Also suitable are alkylmethylsiloxane homopolymers, such as poly(octylmethyl siloxane), alkylmethylsiloxane/arylalkylmethyl siloxane copolymers, such as the copolymer of ethylmethylsiloxane and 2-phenylpropylmethyl siloxane, poly(tetradecylmethyl siloxane), alkylmethyl siloxane/dimethyl siloxane copolymers, (N-pyrrolidone propyl)methyl siloxane/dimethyl siloxane copolymers, and cyanopropylmethylsiloxane/dimethylsiloxane copolymers, all of which are available form Gelest, Inc. Examples of commercially available siloxane block and graft copolymers include poly (dimethylsiloxane/alkylene oxide block copolymers) (available from Gelest, Inc. at siloxane contents ranging from about 15 to about 75 percent by weight and in molecular weights ranging from about 600 to about 30,000), poly(dimethylsiloxane)-block-poly(styrene) (which can be synthesized by the sequential living anionic polymerization of styrene and ring opening polymerization of hexamethylcyclotrisiloxane in accordance with a procedure published by Zilliox et al., *Macromolecules* (1975), 8(5), 573–8) (Dow Corning Q1-2577 conformal coating is thought to be a commercial material containing a polystyrene block segment), and the like.

If desired, instead of providing a single coating of the composition containing the precursor monomers, oligomers, or polymers on the printhead and exposing to ultraviolet radiation, printheads can be made according to the present invention by sequential deposition of layers, in which a thin layer is applied, followed by ultraviolet exposure, and subsequent coating of another thin layer followed by ultraviolet exposure, until the desired number of layers has been obtained. Advantages of this process are related to efficiency and simplicity of film formation when coating a thin primer layer followed by thicker layers. The exposure energy required to crosslink throughout the thickness of a thinner film is also lower. In addition, if desired, in this embodiment of the present invention the composition of the layers can be varied. For example, the first layer coated onto the printhead can be of a composition containing precursors of a relatively high surface energy to enhance wetting and coating uniformity; subsequent layers can be of lower surface energy, with the top layer being uniform and of good quality and also being of a low surface energy.

Preferably the surface of the printhead onto which the precursor materials are applied, such as the front face or nozzle plate, is of a material that forms reactive species upon exposure to ultraviolet radiation to enable covalent bonding between the printhead and the coating material upon exposure. In this process, bond scission leads to interfacial bonding between the printhead and the coating, creating a highly wear resistant coating. Examples of such materials include polyesters, polyimides, poly(arylene ethers), poly (arylene ether ketones), poly(sulfones), poly(styrene), and the like. When the coating is applied to a front face or nozzle plate of a material that does not form reactive species upon exposure to ultraviolet radiation, such as silicon ($SiO_2$), preferably an adhesion promoter is applied to the printhead prior to coating with the precursor materials, and the adhesion promoter layer and precursor layer are simultaneously exposed to ultraviolet radiation to form a strong, wear resistant bond between the printhead and the coating.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A poly(styrene-siloxane) diblock copolymer (Dow Corning® Conformal Coating Q1-2577) was spin coated onto 2×2 inch glass substrates and onto 2×2 inch Upilex® poly (imide) substrates. The coatings were cured with irradiation by a KrF excimer laser emitting at 248 nanometers to crosslink the siloxane copolymer in irradiated areas. The area illuminated was 8 millimeters by 28 millimeters with total exposure in the range of 5 to 85 Joules per square centimeter. These rectangular patterns were developed with a toluene wash, which removed the siloxane that was not crosslinked by the laser. Qualitative examination of the mechanical characteristics of the irradiated polymer films on the poly(imide) substrates indicated that exposures of greater than 20 Joules per square centimeter resulted in good adhesion to the poly(imide) substrate. The thickness of the Q1-2577 film was about 1 micron. This adhesion indicated the formation of covalent bonds between the ultraviolet polymerized siloxane and the substrate. To simulate blade cleaning action on the front face of a thermal ink jet print element, the crosslinked films on Upilex were subjected to ink deposition and the wiping action of a poly(urethane) elastomer blade from the maintenance station of a Xerox XJ-4C printer. The areas irradiated at exposures of greater than 20 Joules per square centimeter were not worn or removed by this action. Further tests with the siloxane coating on the poly(imide) film indicated that nozzles could be ablated through the polyimide substrate and the polysiloxane film. This feature is important for creating ink jet orifices on a substrate having a hydrophobic surface. Ultraviolet laser irradiation of the siloxane films on glass substrates resulted in crosslinked contiguous films. It is believed that the incorporation of an adhesion promoter between the glass substrate and the siloxane will enable excellent adhesion between the polysiloxane film and the glass substrate.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A process for preparing a printhead suitable for ink jet printing which comprises (a) providing an ink jet printhead comprising a plurality of channels, wherein the channels are capable of being filled with ink from an ink supply and wherein the channels terminate in nozzles on one surface of the printhead; (b) applying to said surface a coating of a composition comprising an organosiloxane polymer precursor material; and (c) exposing said organosiloxane precursor material to ultraviolet radiation, thereby causing polymerization, chain extension, and/or crosslinking of the precursor material and covalent bonding of the polymerized, chain extended, and/or crosslinked organosiloxane polymer thereby formed to the surface, said polymerized, chain extended, and/or crosslinked organosiloxane polymer coating being substantially uniform with no additional layers thereover.

2. A process according to claim 1 wherein the organosiloxane polymer is a homopolymer.

3. A process according to claim 1 wherein the organosiloxane polymer is a copolymer of a first, organosiloxane monomer and at least one additional monomer.

4. A process according to claim 1 wherein the organosiloxane polymer is covalently bonded directly to the printhead surface.

5. A process according to claim 1 wherein the organosiloxane polymer is covalently bonded to an adhesion promoter layer, said adhesion promoter layer being covalently bonded to the printhead surface.

6. A process according to claim 1 wherein the printhead has a roofshooter configuration.

7. A process according to claim 1 wherein the printhead has a sideshooter configuration.

8. A process according to claim 1 wherein the coating has a thickness of from about 0.1 to about 100 microns.

9. A process according to claim 1 wherein the coating has a thickness of from about 0.1 to about 20 microns.

10. A process according to claim 1 wherein the precursor material is selected from the group consisting of (i) organosiloxane monomers; (ii) organosiloxane homo-oligomers; (iii) organosiloxane homopolymers; (iv) mixtures of (i) through (iii); (v) organosiloxane co-oligomers; (vi) organosiloxane copolymers; (vii) mixtures of (i) through (vi) with nonorganosiloxane monomers, oligomers, or polymers; and (viii) mixtures of at least two of (i) through (vii).

11. A process according to claim 1 wherein the ultraviolet radiation is provided by an excimer laser.

12. A process according to claim 1 wherein the ultraviolet radiation is provided by a quartz lamp.

13. A process according to claim 1, further including the steps of: (1) prior to applying said precursor material to said surface, applying an adhesion promoter coating to said surface; and (2) applying said precursor material to said adhesion promoter coating on said surface.

14. A printing process which comprises (1) providing an ink jet printer containing a printhead prepared by the process of claim 1; (2) incorporating into the printer an ink composition; and (3) causing droplets of the ink to be ejected in an imagewise pattern onto a recording sheet to form an image.

15. An ink jet printer for ejecting a recording liquid onto a recording medium, said printer comprising a printhead prepared by the process of claim 1.

16. A process according to claim 1 wherein the organosiloxane copolymer is a (N-pyrrolidone propyl) methyl siloxane/dimethyl siloxane copolymer or a cyanopropylmethylsiloxane/dimethylsiloxane copolymer.

17. A process according to claim 2 wherein the organosiloxane polymer is a trimethylsiloxy-terminated phenymethylsiloxane homopolymer or a poly(3,3,3-trifluoropropylmethyl siloxane homopolymer.

18. A process according to claim 3 wherein the organosiloxane copolymer is a trimethylsiloxy-terminated diphenylsiloxane/dimethylsiloxane copolymer, a trimethylsiloxy-terminated phenymethylsiloxane/dimethylsiloxane copolymer, an alkylmethylsiloxane/arylalkylmethyl siloxane copolymer, a (N-pyrrolidone propyl) methyl siloxane/dimethyl siloxane copolymer, or a cyanopropylmethylsiloxane/dimethylsiloxane copolymer.

19. A process according to claim 7 wherein the printhead comprises (a) an upper substrate with a set of parallel grooves for subsequent use as ink channels and a recess for subsequent use as a manifold, the grooves being open at one end for serving as droplet emitting nozzles; and (b) a lower substrate in which one surface thereof has an array of heating elements and addressing electrodes formed thereon, the lower substrate having a thick film insulative layer deposited over the heating elements and addressing electrodes and patterned to form recesses therethrough to expose the heating elements and terminal ends of the addressing electrodes; said upper and lower substrates being aligned, mated, and bonded together to form the printhead with the grooves in the upper substrate being aligned with the heating elements in the lower substrate to form droplet emitting nozzles.

20. A process according to claim 14 wherein the ink jet printer employs a thermal ink jet process wherein the ink in the nozzles is selectively heated in an imagewise pattern, thereby causing droplets of the ink to be ejected in imagewise pattern.

21. A process according to claim 14 wherein the ink jet printer employs an acoustic ink jet process, wherein droplets of the ink are caused to be ejected in imagewise pattern by acoustic beams.

22. A process according to claim 14 wherein the ink jet printer employs a piezoelectric ink jet process, wherein droplets of the ink are caused to be ejected in imagewise pattern by deflection of a piezoelectric transducer.

23. A process according to claim 3 wherein the organosiloxane copolymer is a poly(dimethylsiloxane)/poly(ethylene oxide) block copolymer or a poly(dimethylsiloxane)-block-poly(styrene) copolymer.

24. A process according to claim 3 wherein the at least one additional monomer is a nonorganosiloxane monomer.

25. A process according to claim 24 wherein the nonorganosiloxane monomer is an alkylene oxide monomer, a 2-alkyl oxazoline monomer, an ethylene imine monomer, a caprolactone monomer, an acrylic acid monomer, a methacrylic acid monomer, an acrylate ester monomer, a vinyl monomer, an arylene ether monomer, or an imide monomer.

* * * * *